US005462320A

United States Patent [19]

Davis

[11] Patent Number: 5,462,320

[45] Date of Patent: Oct. 31, 1995

[54] INTERNALLY REMOVABLE SAFETY HASP SYSTEM

[76] Inventor: Roland L. Davis, 881 W. Forest Brook Rd., Maitland, Fla. 32751

[21] Appl. No.: 227,967

[22] Filed: Apr. 15, 1994

[51] Int. Cl.[6] ..... E05C 19/08

[52] U.S. Cl. ..... 292/285; 292/1; 292/DIG. 65; 29/434

[58] Field of Search ..... 292/281, 282, 292/285, 205, DIG. 65, DIG. 64, DIG. 53, 92, 1, 525.1, 434

[56] References Cited

U.S. PATENT DOCUMENTS

| | | | |
|---|---|---|---|
| 1,017,136 | 2/1912 | Chaffee | 292/281 |
| 2,275,760 | 3/1942 | Hoffman | 292/281 |
| 2,743,953 | 5/1956 | Marra et al. | 292/DIG. 65 X |
| 2,823,940 | 2/1958 | Squire | 292/92 |
| 3,871,694 | 3/1975 | White | 292/92 |
| 4,205,868 | 6/1980 | Kurth | 292/1 X |
| 4,431,220 | 2/1984 | Loughlin | 292/DIG. 65 X |
| 4,635,977 | 1/1987 | Yamada | 292/92 |
| 5,026,100 | 6/1991 | Hulkenberg, Jr. | 292/285 X |

*Primary Examiner*—Rodney M. Lindsey
*Attorney, Agent, or Firm*—James H. Beusse

[57] ABSTRACT

A safety hasp (10) is attached to a door (14) and a door frame (16) of a walk-in cooler by threading a rod (35) from inside the cooler, through a bore (34) in door (14) into an aperture (37) of a hasp hinge plate (25) or staple plate (29). The trailing end of rod (35) has a handle (38) which can be turned to release hasp (10) for unlocking door (14) from inside the cooler. Handle (38) has a disc portion (39) including an illuminator (40) for providing temporary "emergency" lighting.

3 Claims, 1 Drawing Sheet

INTERNALLY REMOVABLE SAFETY HASP SYSTEM

This invention relates to a system wherein a safety hasp installed externally on a closure to limit access to an internal space is made removable from inside the space.

BACKGROUND OF THE INVENTION

A safety hasp is a security device having a slotted flap connected at a pin joint to a hinge portion attached by screws to a door or door casement. The slotted part pivots into a "closed" position over the eye ring of a staple attached by screws to the other of the door or door casement. When closed, the flap conceals the screw holes on both the hinge portion and staple plate, so that when a padlock is passed through the eye ring and locked, an intruder cannot unscrew the screws with a screwdriver.

Conventional hasps come in various styles and sizes, with lengths of typically 2¼" to 6¼" and widths of 1" to 2". Though hasps are commonly used on doors, the same also can be used to lock lids of chests and for other types of closures, as well.

It is customary to apply a padlock and hasp, in addition to a factory-installed latch, on the doors of walk-in freezers and similar storage containers in the food service industry. Where hasps are employed on enclosures to limit access to large internal spaces, however, there is a risk that a person will become intentionally or unintentionally locked within the closure. This could occur, for example, where a kitchen employee is inadvertently locked in a meat storage cooler, or where a number of employees are locked into confinement during a robbery.

SUMMARY OF THE INVENTION

The present invention provides a safety hasp and safety hasp installation system, whereby a hasp externally applied on a closure can be removed from within the enclosed space.

In accordance with the invention, one or both of the hasp hinge or staple plate are removably secured by a fastener passed externally from the inside of the confinement space. A preferred embodiment, described in greater detail below, utilizes a threaded rod having a grippable handle. The rod is passed through a bore in the door or casement and threaded into a screw hole of the hasp hinge or staple plate. The rod is then cut off to avoid interference with operation of the flap. Thereafter, should a person become trapped within the hasp-protected enclosure, rotation of the handle from inside the enclosure will unscrew the rod, causing the hinge or staple plate to be freed for opening the closure.

In another aspect of the invention, also described below, the grippable handle is provided with an illuminator which may be activated to provide illumination to the trapped person within the enclosure.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

Figure 1:
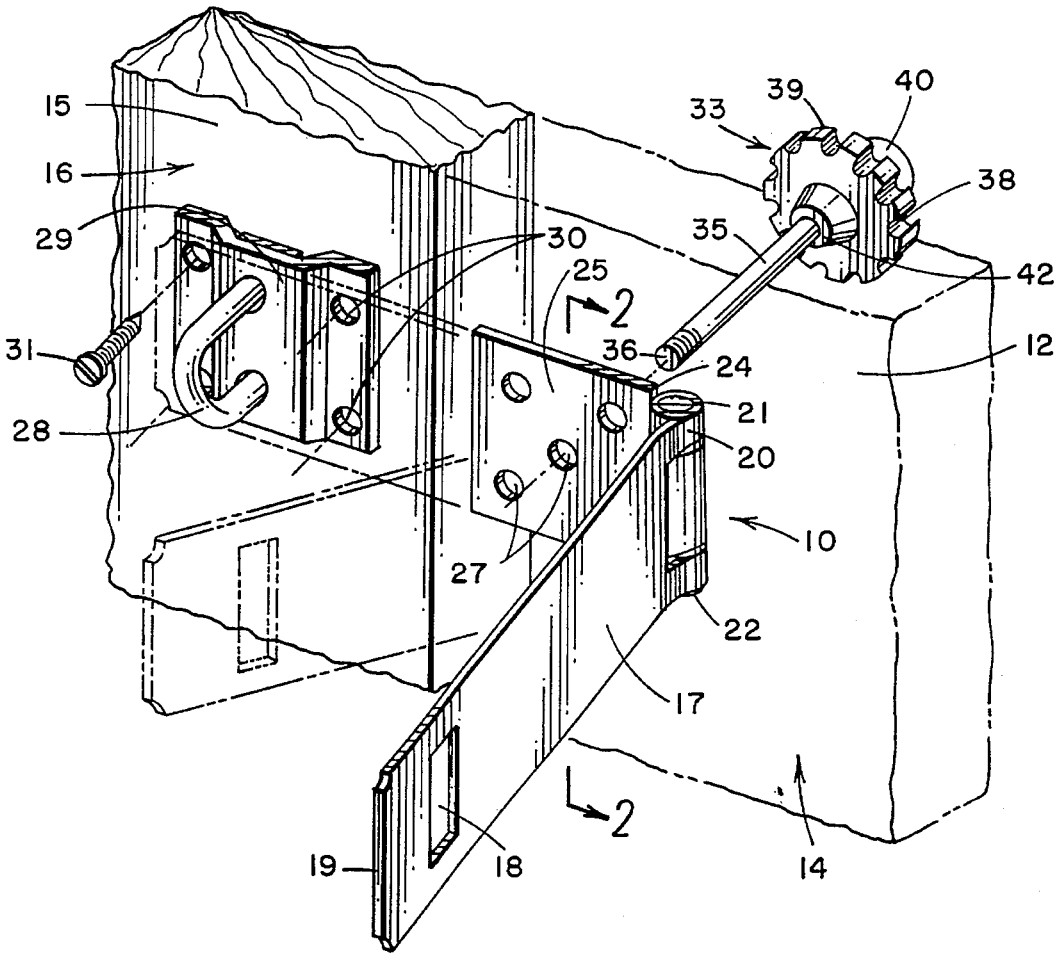
FIG. 1 is an exploded view of a safety hasp system in accordance with the system of the invention.
Figure 2:
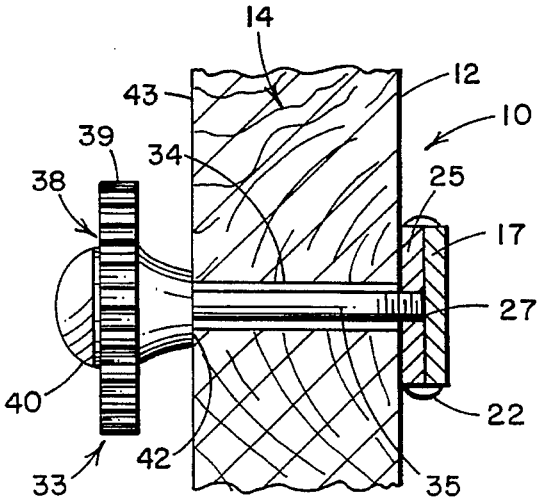
FIG. 2 is a section view, taken along the line 2—2 of FIG. 1.
Figure 3:
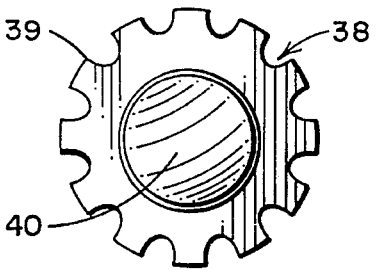
FIG. 3 is a top plan view of the handle end of the fastening rod used to removably secure the hasp in the arrangement shown in FIGS. 1 and 2.

The principles of the invention will be understood by reference to an exemplary implementation thereof described with reference to FIGS. 1–3.

A safety hasp 10 comprises two parts, one attached to an external surface 12 of a walk-in cooler door 14 (shown in phantom in FIG. 1 and in solid lines in FIG. 2) and another attached to an external surface 15 of a door frame 16 of the same cooler. The first part includes, in conventional manner, an elongated planar, generally rectangular flap or strap 17 having a vertical slot 18 adjacent a free first end 19, and a bifurcated second end 20 forming a vertical cylindrical channel 21, through which a pin 22 is passed for pivotal attachment of end 20 to a first lateral edge 24 of a hinge plate portion 25. Hinge plate 25 includes one or more apertures 27 through which fastening means may be threaded to surface 12, externally of the walk-in cooler.

The second part of the hasp system includes an eye ring 28 which projects outwardly from a staple plate base portion 29 and assumes the same vertical orientation as slot 18. In conventional manner, plate 29 has a plurality of screw hole apertures 30 through which conventional screw fasteners 31 are passed for attachment of the second part to surface 15, externally of the walk-in cooler. The first and second parts of the hasp system are relatively dimensioned, configured and adapted so that when the flap 17 is brought from its "open" (shown by solid lines in FIG. 1) to its "closed" (shown by dot-dot-dashed lines in FIG. 1 and solid lines in FIG. 2) position, slot 18 is brought over eye ring 28 for securement of flap 17 in its closed position, with flap 18 covering and concealing the apertures 27, 30, by passing a shackle of a padlock through ring 28.

In accordance with the invention, at least one of the hasp system first and second parts is secured to the corresponding door 14 or door frame 16 from inside the cooler. For the illustrated example, conventional slotted screws 31 are passed in the usual manner to secure hinge plate 25 to door frame 16 from outside the enclosure. The shanks of screws 31 are passed through apertures 30 and threaded into frame 16. In the closed position, the free end 19 of flap 17 covers the heads of screws 31 to prevent their removal. Hinge plate 25 is, however, secured to surface 12 of door 14 by passing a specially configured fastening element 33 from inside the cooler, through a horizontal bore 34 that passes through door 14, and into threaded engagement with a hole 27.

The illustrated embodiment shows a fastening element 33 comprising a length of stainless steel or brass rod 35 which is threaded at a leading end 36 and centrally attached at a trailing end to a grippable handle 38. Handle 38 includes a radially outwardly extending circular disc portion 39, which is circumferentially notched to provide angularly spaced alternating ridges and valleys. Such circumferential contouring both facilitates gripping and enables ready recognition of the handle by feel, in the absence of light. An illuminator 40 is located on the rear face of disc portion 39 for providing temporary "emergency" lighting. Illuminator 40 may take the form of a battery operated flashlight which includes a rotatable lens or on-off switch for energizing a light bulb located within handle 38. Illuminator 40 may, alternatively, take the form of a luminescent chemical substance contained within the handle and activated by kneading or the like.

The security hasp 10 is installed by passing rod 35 through bore 34, from inside the cooler, and threading it into an aperture 27 of hinge plate 25. Rod 35 is threaded into aperture 27 until an enlargement at base 42 of handle 38 is brought flush into engagement with an internal surface 43 of door 14 (see FIG. 2). The leading portion of rod 35, if any, that projects beyond the front surface of hinge plate 25 is then cut off, so that there is no obstruction to movement of the flap 17 into its closed position.

In operation, should a person become trapped within the cooler, when flap 17 is locked in its closed position with slot 18 secured by a padlock over ring 28, rod 35 can be backed out of hinge plate 25 by rotating disc 39 of handle 38, thereby releasing hasp 10 and enabling door 14 to be opened. To alleviate anxiety caused by confinement in darkness, illuminator 40, which is readily accessible from inside the cooler can be activated to provide temporary illumination. This is particularly advantageous in situations, such as a robbery in progress or the like, where immediate egress may not be desirable.

The illustrated embodiment shows use of a single fastening element 33, releasably attaching just the hinge plate part of the hasp at one aperture 27 to one of the door 14 or door frame 16. It is, of course, to be understood that more than one such fastener or aperture can be used, and that either or both of the hinge plate and staple plate parts can be so fastened.

Those skilled in the art to which the invention relates will appreciate that other substitutions and modifications can be made to the described embodiment, without departing from the spirit and scope of the invention as described by the claims below.

What is claimed is:

1. A safety hasp installation system, wherein a safety hasp is installed externally on a door and door frame of a walk-in cooler to limit access to a confinement space located internally within the cooler, said system comprising:

said hasp having first and second parts, said first hasp part including a hinge plate with a first aperture, an elongated strap having a free end with a slot and an opposite end pivotally attached to said hinge plate, and said second hasp part including a staple plate with a second aperture, and an eye ring protruding out from said staple plate;

a first threaded fastener passing through said first aperture and attaching said hinge plate to one of said door and door frame;

a second threaded fastener passing through said second aperture and attaching said staple plate to the other of said door and door frame;

said first and second fasteners functioning to position said first and second hasp parts, so that said slot can be brought over said eye ring for locking said door with said strap covering said first and second apertures to block external access to said first and second fasteners; and at least one of said first and second fasteners being screwed into said corresponding first or second aperture from inside said confinement space toward said corresponding door or door frame; said at least one fastener further comprising a handle located in said confinement space for manually unscrewing said at least one fastener from said corresponding first or second aperture for releasing said attachment of said corresponding hinge plate or staple plate from said door or door frame.

2. A method of attaching a safety hasp to a container having an internal confinement space, an opening surrounded by a closure frame, and a closure covering said opening; said hasp comprising first and second parts; said first hasp part including a hinge plate with a first aperture, an elongated strap having a free end with a slot and an opposite end pivotally attached to said hinge plate; and said second hasp part including a staple plate with a second aperture and an eye ring protruding from said staple plate; and said method comprising the steps of:

attaching said hinge plate to one of said closure frame and closure by passing a first threaded fastener through said first aperture; and attaching said staple plate to the other of said closure frame and closure by passing a second threaded fastener through said second aperture;

said attaching steps being accomplished so as to position said first and second hasp parts, so that said slot can be brought over said eye ring for locking said door with said strap covering said first and second apertures to block external access to said first and second fasteners; and screwing at least one of said first and second fasteners into said corresponding first and second apertures from inside said confinement space through a bore in said door frame or door; providing at least one of said fasteners with a handle; and locating said handle in said confinement space so that said at least one of said fasteners can be manually unscrewed from said first or second aperture.

3. A method as in claim 2, wherein said at least one of said fasteners comprises a length of rod; said rod is threaded at a leading end into said first or second aperture to project beyond a front surface of said hinge plate or staple plate; and said projection beyond said front surface is cut off, so that there is no obstruction to movement of the strap into its aperture covering position.

* * * * *